US009850860B2

(12) United States Patent
Takeuchi

(10) Patent No.: US 9,850,860 B2
(45) Date of Patent: Dec. 26, 2017

(54) OIL REMOVAL APPARATUS

(71) Applicant: TOYOTA JIDOSHA KABUSHIKI KAISHA, Toyota-shi, Aichi-ken (JP)

(72) Inventor: Naoki Takeuchi, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 70 days.

(21) Appl. No.: 14/872,401

(22) Filed: Oct. 1, 2015

(65) Prior Publication Data

US 2016/0097352 A1 Apr. 7, 2016

(30) Foreign Application Priority Data

Oct. 2, 2014 (JP) ..... 2014-203944

(51) Int. Cl.
*B03C 3/155* (2006.01)
*F02M 35/02* (2006.01)
(Continued)

(52) U.S. Cl.
CPC ..... *F02M 35/0217* (2013.01); *B03C 3/08* (2013.01); *B03C 3/155* (2013.01); *B03C 3/41* (2013.01);
(Continued)

(58) Field of Classification Search
CPC combination set(s) only.
See application file for complete search history.

(56) References Cited

U.S. PATENT DOCUMENTS 7,364,606 B2 * 4/2008 Shimoda ..... B03C 3/49 323/903
7,452,410 B2 * 11/2008 Bergeron ..... A61L 9/205 95/57
(Continued)

FOREIGN PATENT DOCUMENTS

JP 59-127621 A 7/1984
JP S59127621 * 7/1984
(Continued)

OTHER PUBLICATIONS

N. Namiki et al., "Characteristics of Particles Generated from Conveyors and Development of a Particle Collection Device for Clean Elevators," Japan Association of Aerosol Science and Technology, vol. 14, No. 4, 338-347 (1999).
(Continued)

*Primary Examiner* — Duane Smith
*Assistant Examiner* — Sonji Turner
(74) *Attorney, Agent, or Firm* — Finnegan, Henderson, Farabow, Garrett & Dunner, LLP

(57) ABSTRACT

Embodiments of the present disclosure may suppress conduction between an anode and a cathode caused by condensed water in an oil removal apparatus in which oil particles are collected in a filter disposed between the anode and the cathode. An insulating layer may be sandwiched either between the filter and at least one of the anode and the cathode of the bipolar electrode, or within the filter so as to extend in a flow direction of blow-by gas, and may have an insulating property so as to prevent condensed water generated when moisture in the blow-by gas condenses, from connecting the anode and the cathode of the bipolar electrode.

9 Claims, 6 Drawing Sheets

(51) Int. Cl.

| | |
|---|---|
| ***F02M 35/024*** | (2006.01) |
| ***B03C 3/08*** | (2006.01) |
| ***B03C 3/41*** | (2006.01) |
| ***B03C 3/47*** | (2006.01) |
| ***F01M 13/04*** | (2006.01) |
| ***B03C 3/60*** | (2006.01) |
| ***B03C 3/70*** | (2006.01) |

(52) U.S. Cl.

CPC ..... *B03C 3/47* (2013.01); *B03C 3/60* (2013.01); *B03C 3/70* (2013.01); *F01M 13/04* (2013.01); *F02M 35/024* (2013.01); *B03C 2201/30* (2013.01); *F01M 2013/0438* (2013.01); *F01M 2013/0466* (2013.01)

(56) References Cited

U.S. PATENT DOCUMENTS

| | | | | |
|---|---|---|---|---|
| 7,625,435 | B2 * | 12/2009 | Dooley | B03C 9/00 95/68 |
| 8,096,290 | B2 * | 1/2012 | Karlsson | F01M 13/04 123/572 |
| 8,308,846 | B2 * | 11/2012 | Op de Laak | B03C 3/41 60/275 |
| 8,449,637 | B2 * | 5/2013 | Heinen | B01D 45/08 123/198 E |
| 2001/0020417 | A1 | 9/2001 | Liu et al. | |
| 2002/0092424 | A1 | 7/2002 | Liu et al. | |
| 2005/0224022 | A1 | 10/2005 | Heckel et al. | |
| 2005/0224023 | A1 | 10/2005 | Heckel et al. | |
| 2005/0224061 | A1 * | 10/2005 | Ulrich | F01M 13/04 123/573 |
| 2005/0237693 | A1 * | 10/2005 | Heckel | B03C 3/49 361/212 |
| 2006/0254264 | A1 * | 11/2006 | Takenaka | B03C 3/08 60/297 |
| 2007/0261556 | A1 * | 11/2007 | Kasai | B01D 53/32 96/74 |
| 2015/0113959 | A1 * | 4/2015 | Mitani | B03C 3/41 60/275 |
| 2015/0337697 | A1 * | 11/2015 | Kira | F01M 13/04 123/41.86 |

FOREIGN PATENT DOCUMENTS

| | | | |
|---|---|---|---|
| JP | 61-133155 | | 6/1986 |
| JP | 2002/530192 | A | 9/2002 |
| JP | 2005-103357 | A | 4/2005 |
| JP | 2005-334876 | | 12/2005 |
| JP | 2007-198344 | A | 8/2007 |
| JP | 2010-90873 | | 4/2010 |
| JP | 2013-34941 | | 2/2013 |
| WO | WO 00/30755 | A2 | 6/2000 |

OTHER PUBLICATIONS

T. Kawamoto et al., "Study on the Removal Mechanism of Lubricant Oil Particles Exhausted from Air Compressor (Second Report)," Proceedings for Academic Symposia of Society of Automotive Engineers of Japan, Inc. (JSAE), Document No. 20135865 No. 118-13 (2013).

* cited by examiner

[Fig. 1]
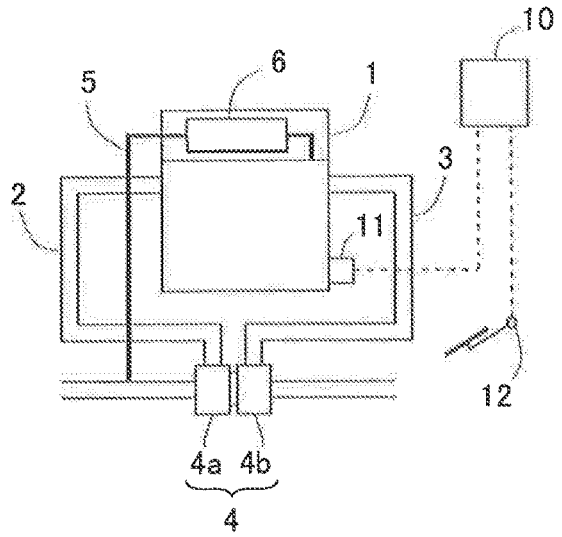
[Fig. 2]
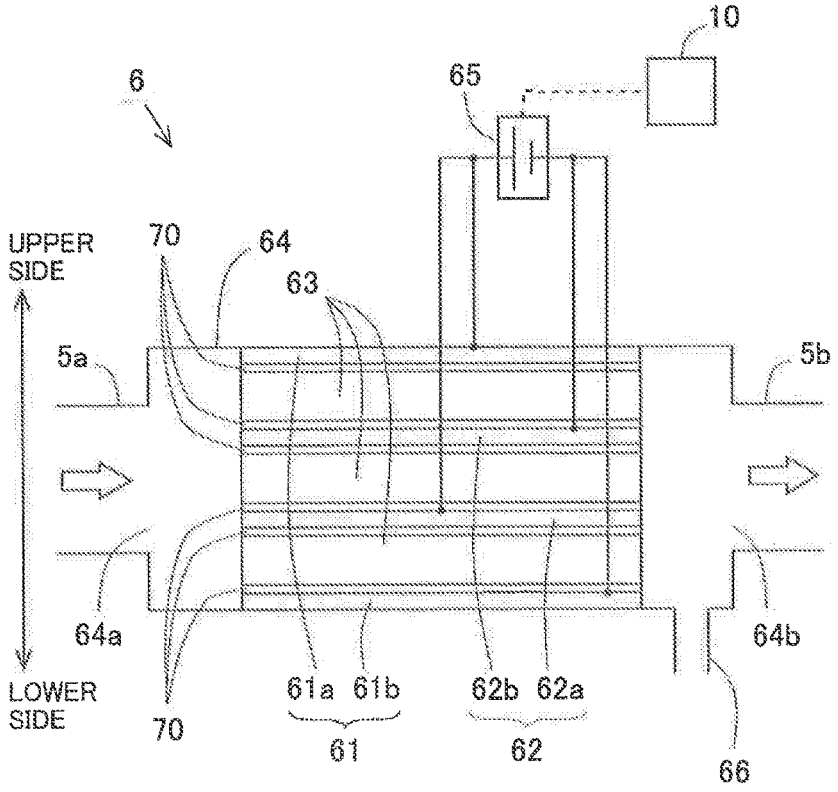

[Fig. 3]
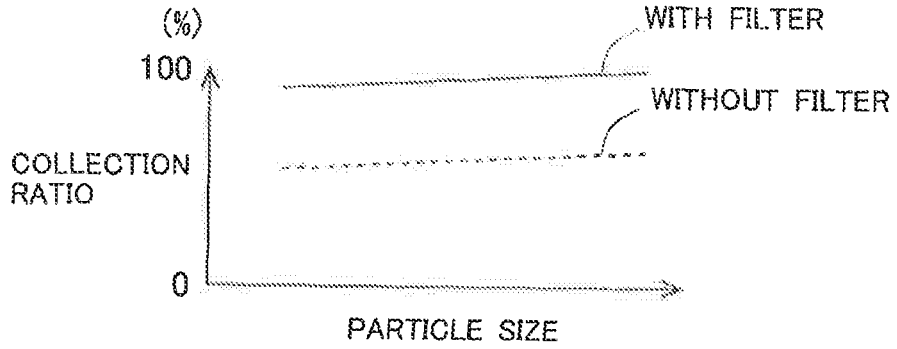
[Fig. 4]
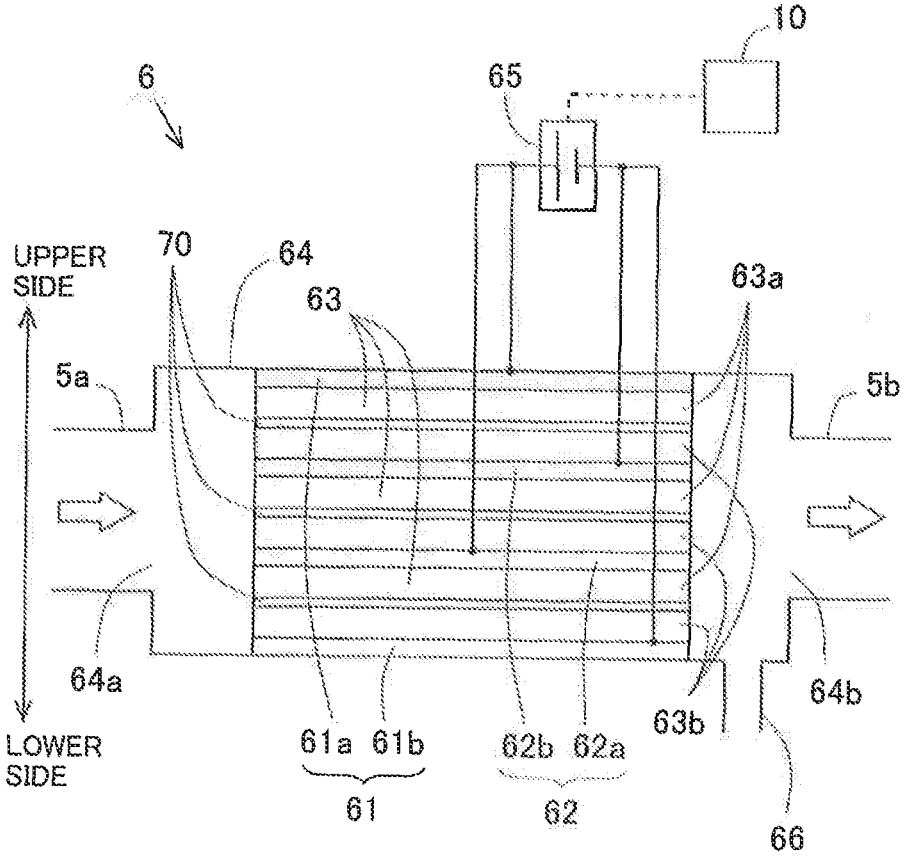

[Fig. 6]
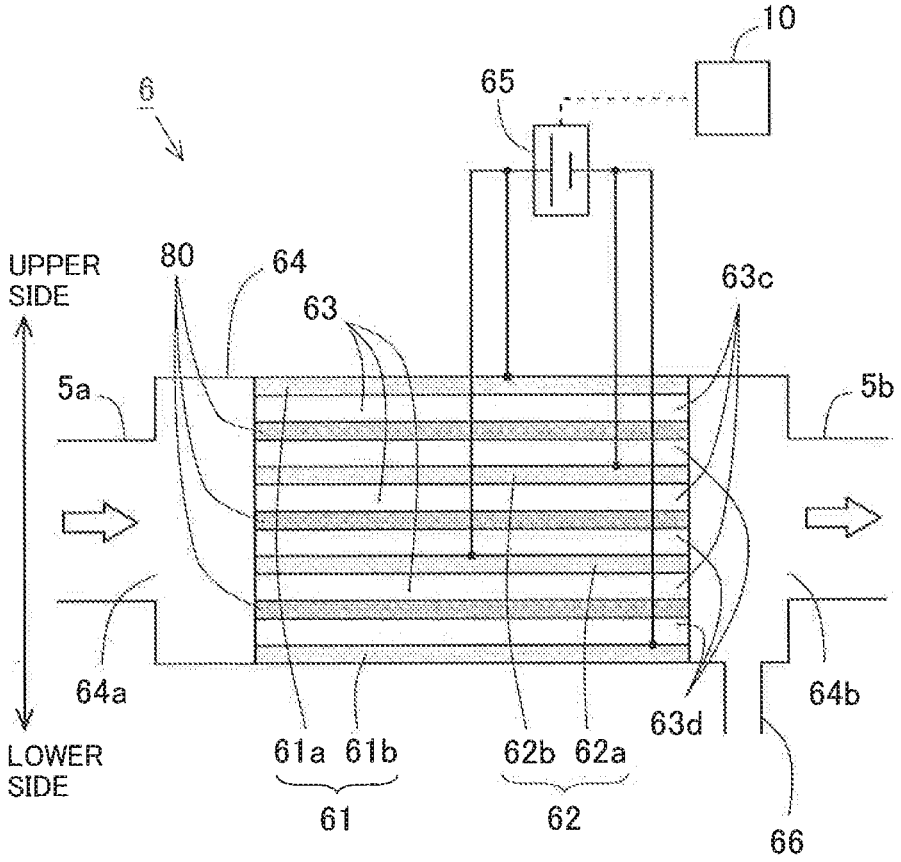

[Fig. 7]
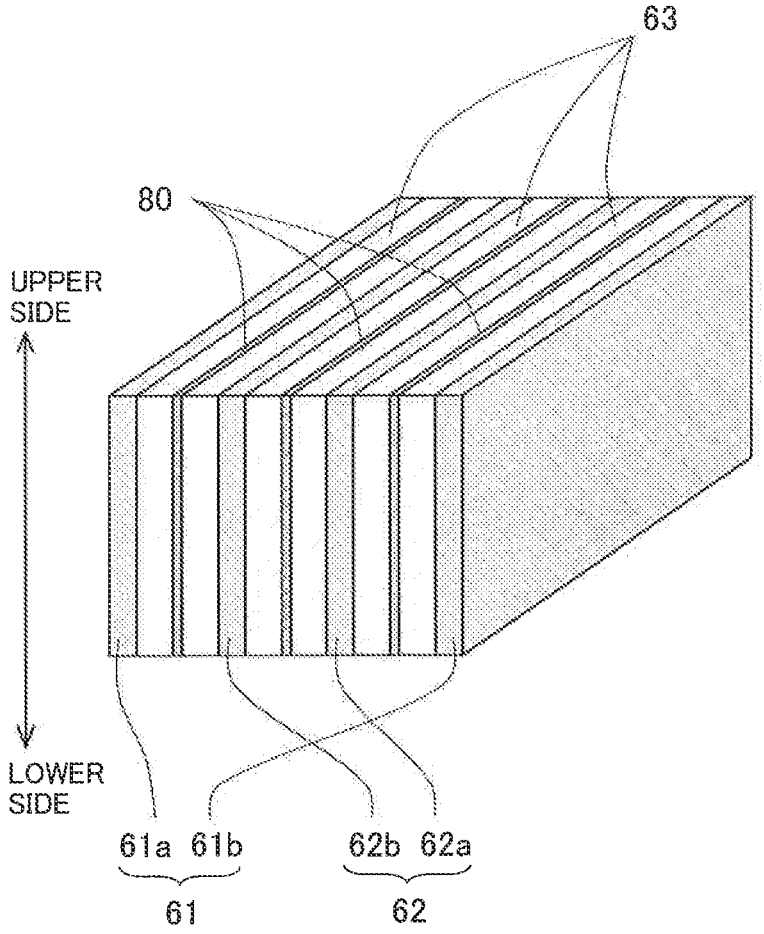

[Fig. 8]
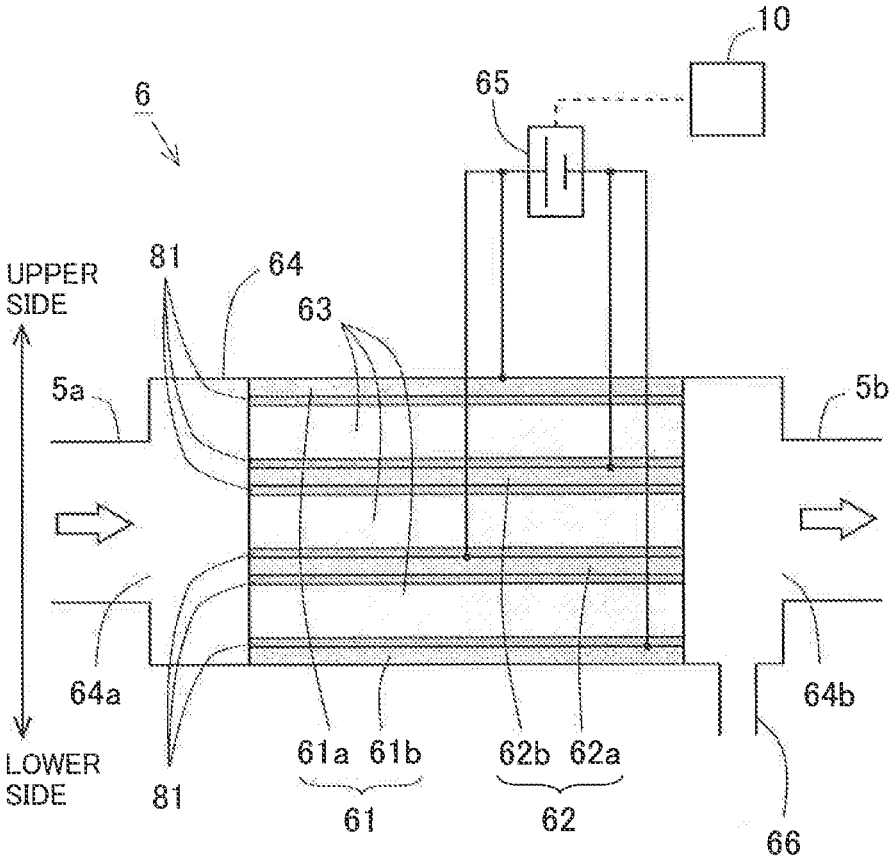

OIL REMOVAL APPARATUS

BACKGROUND

Technical Field

The present disclosure relates to an oil removal apparatus that removes oil particles (e.g., oil mist) contained in blow-by gas in an internal combustion engine.

Description of the Related Art

In a conventional technique employed in an internal combustion engine, blow-by gas is recirculated to an intake system from a crank case through a blow-by gas passage. An oil removal apparatus that removes oil particles contained in the blow-by gas is provided in the blow-by gas passage. Japanese Patent Application Publication No. 2005-334876, for example, discloses an electrostatic precipitator having a collector electrode that collects ionized oil mist within an electric field created by a pulse-driven high voltage corona discharge electrode.

Further, Japanese Patent Application Publication No. S61-133155 discloses an electrostatic purification apparatus that removes microparticulate matter contained in engine oil. The electrostatic purification apparatus is structured such that an insulating filter is provided between electrodes.

Furthermore, Japan Association of Aerosol Science and Technology vol. 14 No. 4, 338-347 (1999) discloses a microparticle removal unit used in a clean elevator of a clean room. This removal unit mainly removes microparticles believed to originate from oil using a dielectric filter method. The removal unit is structured such that a nonwoven fabric serving as a dielectric fiber layer is filled between an anode and a cathode of a parallel plate electrode. Dielectric polarization is generated in the nonwoven fabric by applying a voltage to the electrodes, and microparticles are collected in the nonwoven fabric using a dielectric polarization force that acts between the fibers and the microparticles in addition to Coulomb force acting on charged particles.

SUMMARY

When a method of using dielectric polarization of a filter is employed in an oil removal apparatus that removes oil particles contained in blow-by gas flowing through a blow-by gas passage of an internal combustion engine, the oil removal apparatus is configured such that a filter formed from an insulator is disposed between an anode and a cathode extending in a flow direction of the blow-by gas of a bipolar electrode. With this configuration, dielectric polarization is generated in the filter by applying a voltage to the bipolar electrode such that dielectric polarization force acts on the oil particles flowing through the filter. Further, many of the oil particles contained in the blow-by gas are charged, and therefore, when a voltage is applied to the bipolar electrode, Coulomb force acts on the charged oil particles in addition to the dielectric polarization force. As a result, the oil particles are collected in the filter and thereby removed from the blow-by gas.

Here, the blow-by gas contains moisture, and therefore condensed water may be generated in the oil removal apparatus when the moisture in the blow-by gas condenses. When condensed water is generated in the oil removal apparatus configured as described above, the condensed water may spread through the filter such that conduction occurs between the anode and the cathode. When conduction occurs between the anode and the cathode due to the condensed water, power consumption may increase.

Embodiments of the present disclosure have been designed in consideration of the problem described above. The embodiments may suppress conduction between an anode and a cathode of a bipolar electrode caused by condensed water in an oil removal apparatus in which oil particles are collected in a filter disposed between the anode and the cathode.

In an oil removal apparatus according to some embodiments, an insulating layer that has an insulating property and prevents condensed water from connecting an anode and a cathode of a bipolar electrode is provided either between a filter and at least one of the anode and the cathode of the bipolar electrode or within the filter.

In some embodiments, an oil removal apparatus removes oil particles contained in blow-by gas flowing through a blow-by gas passage of an internal combustion engine, and includes:

a bipolar electrode having an anode and a cathode that extend in a flow direction of the blow-by gas;

a voltage applicator that applies a voltage to the bipolar electrode;

a filter disposed between the anode and the cathode of the bipolar electrode, in which dielectric polarization occurs when the voltage applicator applies a voltage to the bipolar electrode; and an insulating layer that is sandwiched either between the filter and at least one of the anode and the cathode of the bipolar electrode or within the filter so as to extend in the flow direction of the blow-by gas, and that has an insulating property so as to prevent condensed water generated when moisture in the blow-by gas condenses from connecting the anode and the cathode of the bipolar electrode.

In some embodiments, the insulating layer, which differs from the filter, is provided either between the filter and the anode or cathode of the bipolar electrode, or within the filter. The insulating layer is configured to prevent condensed water from connecting the anode and the cathode of the bipolar electrode. Hence, even when condensed water spreads through the filter, spreading of the condensed water between the anode and the cathode is blocked by the insulating layer. According to the present disclosure, therefore, conduction between the anode and the cathode caused by the condensed water can be suppressed.

In the present disclosure, the anode and the cathode of the bipolar electrode may be arranged in a gravitational direction (e.g., vertical direction) when the oil removal apparatus is installed in a vehicle. Likewise in this example, the filter is disposed between the anode and the cathode. Further, in this example, the insulating layer may be a space layer that is positioned between the filter and either the anode or the cathode, and formed from a space through which the blow-by gas flows. Alternatively, the filter may be divided into an anode side filter positioned on the anode side and a cathode side filter positioned on the cathode side, and the insulating layer may be a space layer that is positioned between the anode side filter and the cathode side filter, and formed from a space through which the blow-by gas flows. With these configurations, even when condensed water spreads through the filter, the condensed water does not spread to the anode or the cathode. Further, in situations where the oil removal apparatus is installed in a vehicle, droplets of the condensed water may drip downward through the space layer in the gravitational direction. However, in this case, the droplets of condensed water do not remain in the space layer. Hence, the space layer may prevent spreading of the condensed water between the anode and the cathode. As a result, conduction between the anode and the cathode due to the condensed water can be suppressed by the space layer.

Further, in the examples described above, the filter may be a fibrous filter, and hydrophobic treatment may be implemented on a surface of fiber forming the fibrous filter. In this example, condensed water on the surface of the fiber forming the filter is more likely to form droplets and less likely to infiltrate the fiber. The condensed water is therefore less likely to spread through the filter. Moreover, the droplets of condensed water are more likely to drip downward in the gravitational direction. According to this configuration, therefore, the condensed water is less likely to spread through the filter, and as a result, conduction between the anode and the cathode caused by the condensed water can be suppressed more reliably.

Furthermore, in the examples described above, when the space layer is formed between the filter and a lower electrode, which is a bipolar electrode, from among the anode and the cathode of the bipolar electrode, that is positioned below the filter in the gravitational direction when the oil removal apparatus is installed in a vehicle, hydrophilic treatment may be implemented on a surface of the lower electrode that contacts the space layer. According to this configuration, droplets of condensed water dripping onto the lower electrode are less likely to remain in droplet form on the lower electrode, and are therefore more likely to spread thinly over the surface of the lower electrode. Hence, conduction between the anode and the cathode caused by the condensed water can be suppressed even when the space layer is reduced in thickness. Moreover, by reducing the thickness of the space layer, a reduction in an oil particle collection ratio (a ratio of an amount of collected oil particles relative to an amount of inflowing oil particles) of the oil removal apparatus can be suppressed.

In embodiments, the insulating layer may be a water blocking layer that is formed from an insulator and is less permeable than the filter. With this configuration, condensed water is unlikely to infiltrate the water blocking layer. Therefore, even when condensed water spreads through the filter, spreading of the condensed water between the anode and the cathode is prevented by the water blocking layer. Hence, conduction between the anode and the cathode due to the condensed water can be suppressed by the water blocking layer. Furthermore, with this configuration, dielectric polarization occurs likewise in the water blocking layer when a voltage is applied to the bipolar electrode. Therefore, a reduction in the oil particle collection ratio is unlikely to occur likewise when the water blocking layer is provided as the insulating layer.

In the examples described above, the water blocking layer may be formed from a flat plate-shaped water blocking plate that extends in the flow direction of the blow-by gas. Further, the water blocking layer may be a coating layer covering a surface of the anode or the cathode. In this case, the water blocking layer can be formed by coating the surface of the anode or the cathode with an insulating material having low permeability.

In some embodiments, in an oil removal apparatus that collects oil particles in a filter disposed between an anode and a cathode of a bipolar electrode, conduction between the anode and the cathode caused by condensed water can be suppressed.

BRIEF DESCRIPTION OF THE DRAWINGS

FIG. 1 is a schematic view showing a configuration of an internal combustion engine, and an intake/exhaust system thereof, according to an embodiment;

FIG. 2 is a schematic view showing a configuration of an oil removal apparatus according to a first embodiment;

FIG. 3 is a graph showing an oil particle collection ratio of the oil removal apparatus;

FIG. 4 is a schematic view showing a configuration of an oil removal apparatus according to a modified example of the first embodiment;

FIG. 6 is a schematic view showing a configuration of an oil removal apparatus according to a second embodiment;

FIG. 7 is a view showing an arrangement of electrodes in an oil removal apparatus according to a modified example of the second embodiment; and FIG. 8 is a schematic view showing a configuration of an oil removal apparatus according to a modified example of the second embodiment.

DETAILED DESCRIPTION

Figure 5A:
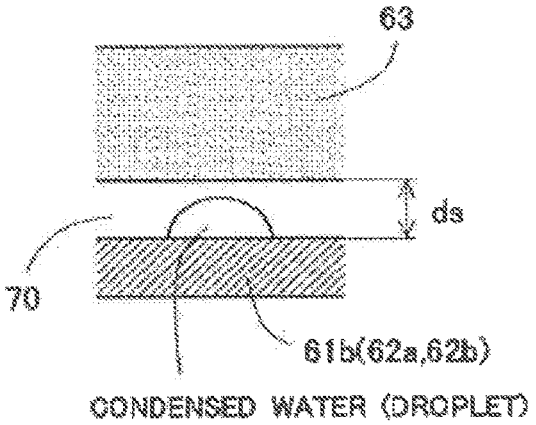
FIGS. 5A and 5B are image views showing condensed water on a lower electrode according to the first embodiment and a modified example thereof, respectively.

Specific embodiments of the present disclosure will be described below on the basis of the drawings. Unless specified otherwise, the technical scope of the present disclosure is not limited to the dimensions, materials, shapes, relative arrangements, and so on of constituent components described for the embodiments.

First Embodiment

An embodiment in which the oil removal apparatus according to the present disclosure is applied to a diesel engine will be described. Note that the oil removal apparatus according to the present disclosure is not limited to a diesel engine, and may be employed in another engine that uses oil (lubricating oil), such as a gasoline engine.

[Configuration of Internal Combustion Engine and Intake/Exhaust System Thereof]

FIG. 1 is a schematic view showing a configuration of the internal combustion engine and an intake/exhaust system thereof according to this embodiment. An internal combustion engine 1 is a diesel engine installed in a vehicle. An intake passage 2 and an exhaust passage 3 are connected to the internal combustion engine 1. A compressor 4*a* of a turbocharger 4 is provided midway in the intake passage 2. A turbine 4*b* of the turbocharger 4 is provided midway in the exhaust passage 3.

An electronic control unit (ECU) 10 is provided alongside the internal combustion engine 1. A crank position sensor 11 and an accelerator operation amount sensor 12 are electrically connected to the ECU 10. The crank position sensor 11 detects a rotation position of an output shaft (a crankshaft) of the internal combustion engine 1. The accelerator operation amount sensor 12 detects an accelerator operation amount of the vehicle in which the internal combustion engine 1 is installed. Output signals from the respective sensors are input into the ECU 10. The ECU 10 calculates an engine load of the internal combustion engine 1 on the basis of an output value from the accelerator operation amount sensor 12. Further, the ECU 10 calculates an engine rotation speed of the internal combustion engine 1 on the basis of an output value from the crank position sensor 11.

The internal combustion engine 1 is further provided with a blow-by gas passage 5. One end of the blow-by gas passage 5 communicates with a crank case of the internal combustion engine 1. The blow-by gas passage 5 extends through a cylinder head cover of the internal combustion engine 1 such that the other end thereof is connected to the intake passage 2 on an upstream side of the compressor 4*a*. Blow-by gas is recirculated to the intake passage 2 from the crank case through the blow-by gas passage 5.

The blow-by gas contains oil particles (e.g., oil mist) generated when oil is scattered in the internal combustion engine 1. Hence, an oil removal apparatus 6 is provided in the blow-by gas passage 5 within the cylinder head of the internal combustion engine 1 in order to remove the oil particles contained in the blow-by gas.

[Configuration of Oil Removal Apparatus]

FIG. 2 is a schematic view showing a configuration of the oil removal apparatus according to this embodiment. Note that upper and lower sides of FIG. 2 correspond to upper and lower sides in a gravitational direction when the oil removal apparatus 6 is installed in a vehicle. Further, black-outlined arrows in FIG. 2 denote the flow of the blow-by gas.

A first bipolar electrode 61, a second bipolar electrode 62, and a filter 63 are provided in a case 64 of the oil removal apparatus 6. An upstream side (crank case side) blow-by gas passage 5*a* is connected to a gas inlet 64*a* of the case 64. The blow-by gas flows into the case 64 from the blow-by gas passage 5*a* through the gas inlet 64*a*. A downstream side (intake passage side) blow-by gas passage 5*b* is connected to a gas outlet 64*b* of the case 64. The blow-by gas flows out of the case 64 into the blow-by gas passage 5*b* through the gas outlet 64*b*.

The first bipolar electrode 61 is a parallel plate electrode including an anode 61*a* and a cathode 61*b* that extend in a flow direction of the blow-by gas. The second bipolar electrode 62 is a parallel plate electrode including an anode 62*a* and a cathode 62*b* that extend in the flow direction of the blow-by gas, and is provided between the anode 61*a* and the cathode 61*b* of the first bipolar electrode 61. Further, when the oil removal apparatus 6 is installed in the vehicle, the anode 61*a* and cathode 61*b* of the first bipolar electrode 61 and the anode 62*a* and cathode 62*b* of the second bipolar electrode 62 are arranged in the gravitational direction. Furthermore, the anode 62*a* of the second bipolar electrode 62 is positioned on the side of the cathode 61*b* of the first bipolar electrode 61, while the cathode 62*b* of the second bipolar electrode 62 is positioned on the side of the anode 61*a* of the first bipolar electrode 61. In other words, the respective electrodes are disposed such that the anode 62*a* and the cathode 62*b* of the second bipolar electrode 62 face each other, the anode 61*a* of the first bipolar electrode 61 and the cathode 62*b* of the second bipolar electrode 62 face each other, and the cathode 61*b* of the first bipolar electrode 61 and the anode 62*a* of the second bipolar electrode 62 face each other.

The filter 63 is provided between the anode 61*a* of the first bipolar electrode 61 and the cathode 62*b* of the second bipolar electrode 62, between the cathode 62*b* of the second bipolar electrode 62 and the anode 62*a* of the second bipolar electrode 62, and between the anode 62*a* of the second bipolar electrode 62 and the cathode 61*b* of the first bipolar electrode 61. The filter 63 is a fibrous filter formed from insulating fiber such as polyethylene terephthalate (PET) or glass fiber. Further, to reduce pressure loss, a filter having a small filling factor (a filling factor of approximately 0.014 (1.4%), for example) is employed as the filter 63. Moreover, space layers 70 are provided between the filters 63 and the respective electrodes 61*a*, 61*b*, 62*a*, 62*b*. The space layer 70 will be described in detail below. Note that the filters 63 do not necessarily have to be provided over an entire region the anode and the cathode from an upstream end to a downstream end of the electrodes.

Furthermore, a drain passage 66 is connected to a lower side of the case 64 on a downstream side of the part in which the bipolar electrodes 61, 62 and the filters 63 are disposed. The drain passage 66 communicates with the interior of the cylinder head of the internal combustion engine 1. Recovered oil collected by the filters 63 is returned to the internal combustion engine 1 through the drain passage 66. To enable the recovered oil to flow into the drain passage 66 more easily, the oil removal apparatus 6 may be disposed in the cylinder head of the internal combustion engine 1 at an incline so that the gas outlet 64*b* of the case 64 is positioned below the gas inlet 64*a*. Further, a lower wall surface of the case 64 may be formed as an inclined surface such that the gas outlet 64*b* side of the case 64 is positioned below the gas inlet 64*a* side. Moreover, a guide passage for guiding the recovered oil to the drain passage 66 may be provided in the lower wall surface of the case 64. Furthermore, the respective electrodes may be constituted by lattice-shaped lattice electrodes so that the oil collected by the filters 63 can reach the lower wall surface of the case 64 through the filters 63.

The respective bipolar electrodes 61, 62 are electrically connected to a power supply 65 that applies a voltage to the bipolar electrodes 61, 62. The power supply 65 is electrically connected to the ECU 10. Voltage application to the respective bipolar electrodes 61, 62 is controlled by the ECU 10.

Note that in the oil removal apparatus according to this embodiment, a configuration employing two bipolar electrode sets, namely the first and second bipolar electrodes 61, 62, is employed. However, the oil removal apparatus according to the present disclosure is not limited to this electrode configuration, and a configuration having a single bipolar electrode set or a configuration having three or more bipolar electrode sets may be employed instead.

[Mechanism for Collecting Oil Particles]

A mechanism by which the oil particles contained in the blow-by gas are collected in the oil removal apparatus according to this embodiment will now be described. In the oil removal apparatus 6, as described above, the filling factor of the filter 63 is small, and therefore, when no voltage is applied to the bipolar electrodes 61, 62, substantially none of the oil particles contained in the blow-by gas are collected in the filters 63. When a voltage is applied to the bipolar electrodes 61, 62, however, dielectric polarization force and Coulomb force act on the oil particles, and as a result, the oil particles are collected in the filters 63.

FIG. 3 is a graph showing an oil particle collection ratio of the oil removal apparatus. A solid line in FIG. 3 shows the oil particle collection ratio when a voltage is applied to the electrodes of an oil removal apparatus configured such that a filter formed from an insulator and having a small filling factor, as in this embodiment, is provided between the anode and the cathode. Further, a dotted line in FIG. 3 shows the oil particle collection ratio when a voltage is applied to the electrodes of an oil removal apparatus configured such that a filter is not provided between the anode and the cathode. The solid line and the dotted line in FIG. 3 show the collection ratio in cases where an identical predetermined voltage is applied to the electrodes of both oil removal apparatuses. Note that in FIG. 3, the ordinate shows the oil particle collection ratio of the oil removal apparatus, and the abscissa shows a particle size of the oil particles. Furthermore, numerical values of the oil particle collection ratio in FIG. 3 are numerical values obtained in a case where a distance between the anode and the cathode is set at a specific distance, and when the filter is provided (the solid line), the filling factor of the filter is set at a specific filling factor. In other words, the numerical values of the oil particle collection ratio shown in FIG. 3 are merely examples, and these numerical values vary in accordance with the distance between the anode and the cathode.

As shown by the dotted line in FIG. 3, even with the configuration in which a filter is not provided between the anode and the cathode, when the predetermined voltage is applied to the electrodes, an oil particle collection ratio of at least 50% is obtained, regardless of the particle size of the oil particles. In other words, a part of the oil particles contained in the blow-by gas is collected by the electrodes even when a filter is not provided between the anode and the cathode. The reason for this is that when oil in respective operating parts of the internal combustion engine turns into mist, many of the oil particles are charged, and therefore many of the oil particles in the blow-by gas are charged. Hence, when a voltage is applied to the bipolar electrodes in the oil removal apparatus, Coulomb force acts on the charged oil particles.

Further, as shown by the solid line in FIG. 3, with the configuration in which the filter is provided between the anode and the cathode, the oil particle collection ratio of the oil removal apparatus improves in comparison with the configuration in which a filter is not provided between the anode and the cathode such that a collection ratio of approximately 90% is obtained. The reason for this is that when a voltage is applied to the bipolar electrodes, dielectric polarization occurs in the filter formed from an insulator (a dielectric), and therefore dielectric polarization force acts on the oil particles contained in the blow-by gas in addition to the Coulomb force, with the result that the oil particles are collected in the filter. The Coulomb force acts only on the charged oil particles, whereas the dielectric polarization force also acts between uncharged oil particles and the filter. Therefore, not only the charged oil particles but also the uncharged oil particles are collected in the filter. Furthermore, the force acting on the uncharged oil particles increases by applying the dielectric polarization force to the uncharged oil particles in addition to the Coulomb force. Hence, with the configuration in which the filter is provided between the anode and the cathode, even though the filter has such a small filling factor that substantially no oil particles are collected therein when no voltage is applied to the electrodes, the oil particle collection ratio of the oil removal apparatus is higher than with the configuration in which the filter is not provided between the anode and the cathode.

[Countermeasures Against Condensed Water]

The blow-by gas contains moisture. Hence, the moisture in the blow-by gas may condense inside the oil removal apparatus 6 so as to generate condensed water. When the condensed water spreads through the filter 63, the condensed water may cause conduction to occur between the anode and the cathode of the bipolar electrode, which are provided to face each other on either side of the filter 63, and as a result, power consumption may increase. In the oil removal apparatus 6, therefore, the space layers 70 are provided to suppress conduction between the anode and the cathode caused by condensed water. The space layers 70 are formed from spaces positioned between the filter 63 and the respective electrodes 61*a*, 61*b*, 62*a*, 62*b*, and through which the blow-by gas flows. In other words, surfaces of the respective electrodes 61*a*, 61*b*, 62*a*, 62*b* that oppose the filters 63 and surfaces of the filters 63 that oppose the electrodes 61*a*, 61*b*, 62*a*, 62*b* contact the space layers 70.

The space layers 70 themselves function as insulating layers. Further, by providing the space layers 70, even when condensed water spreads through the filters 63, the condensed water does not spread to the anode or the cathode. Moreover, the space layers 70 have a predetermined thickness and are sandwiched between the filters 63 and the anode or the cathode in the gravitational direction, and therefore condensed water in the form of droplets may drip downward in the gravitational direction through the space layers 70. In other words, droplets of condensed water formed in the filter 63 may drip through the space layer 70 onto the electrode positioned below the filter 63 in the gravitational direction. Furthermore, droplets of condensed water formed on the surface of the electrode may drip through the space layer 70 onto the filter 63 positioned below the electrode in the gravitational direction. Even in these cases, however, the droplets of condensed water do not remain in the space layers 70. In other words, the droplets of condensed water pass through the space layers 70, but since the space layers 70 have a predetermined thickness, the droplets of condensed water do not contact the surface of the filter 63 and the surface of the electrode at the same time.

According to this configuration, even when condensed water spreads through the filter 63, the condensed water is prevented from connecting the anode and the cathode of the bipolar electrode, which oppose each other on either side of the filter 63, by the space layer 70. Hence, by providing the space layers 70, conduction between the anode and the cathode caused by the condensed water can be suppressed.

First Modified Example

Note that in the configuration shown in FIG. 2, the space layer 70 is provided both between the filter 63 and the anode and between the filter 63 and the cathode. However, a configuration in which the space layer 70 is only provided either between the filter 63 and the anode or between the filter 63 and the cathode may be employed as the configuration of the oil removal apparatus 6. Likewise in this case, the space layer 70 prevents condensed water from connecting the anode and the cathode of the bipolar electrode, which oppose each other on either side of the filter 63.

Second Modified Example

Further, as shown in FIG. 4, a configuration in which the space layer 70 is provided within the filter 63 disposed between the anode and the cathode of the bipolar electrode may be employed as the configuration of the oil removal apparatus 6. In this case, the filter 63 is divided by the space layer 70 into an anode side filter positioned on the anode side and a cathode side filter positioned on the cathode side. Hereafter, the filter positioned on the upper side in the gravitational direction, of the filter 63 divided by the space layer 70, will be referred to as an upper filter 63*a*, and the filter positioned on the lower side in the gravitational direction will be referred to as a lower filter 63*b*.

In a case where the space layer 70 is provided between the upper filter 63*a* and the lower filter 63*b*, even when condensed water spreads respectively through the upper filter 63*a* and the lower filter 63*b*, the condensed water spreading through one of the filters does not reach the other filter. Further, droplets of condensed water formed in the upper filter 63*a* may drip into the lower filter 63*b* through the space layer 70, but likewise in this case, the condensed water does not remain in the space layer 70. In other words, the droplets of condensed water pass through the space layer 70, but since the space layer 70 has a predetermined thickness, the droplets of condensed water do not contact a surface of the upper filter 63*a* and a surface of the lower filter 63*b* at the same time. Hence, likewise with a configuration in which the space layer 70 is provided within the filter 63, the space layer 70 prevents condensed water from connecting the anode and the cathode of the bipolar electrode, which oppose each other on either side of the filter 63.

Third Modified Example

Further, in a case where the space layers 70 are provided between the filters 63 and the electrodes (referred to hereafter as lower electrodes) 61*b*, 62*a*, 62*b* positioned respectively below the filters 63 in the gravitational direction, hydrophilic treatment may be implemented on the surfaces of the lower electrodes 61*b*, 62*a*, 62*b* that contact the space layers 70. Processing for coating the surfaces of the electrodes with a substance containing a silanol group as a functional group may be cited as an example of hydrophilic treatment.

Figure 5B:
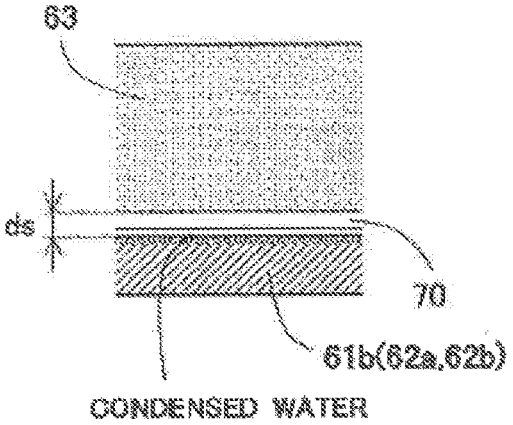

FIGS. 5A and 5B are image views showing condensed water on the lower electrode. FIG. 5A shows condensed water when hydrophilic treatment is not implemented on the surface of the lower electrode, and FIG. 5B shows condensed water when hydrophilic treatment is implemented on the surface of the lower electrode that contacts the space layer. As described above, droplets of condensed water formed in the filters 63 may drip through the space layers 70 onto the lower electrodes 61*b*, 62*a*, 62*b*. If, at this time, hydrophilic treatment is not implemented on the surfaces of the lower electrodes 61*b*, 62*a*, 62*b*, as shown in FIG. 5A, the droplets of condensed water dripping onto the lower electrodes 61*b*, 62*a*, 62*b* are more likely to remain in droplet form on the lower electrodes 61*b*, 62*a*, 62*b*. When the droplets of condensed water on the lower electrodes 61*b*, 62*a*, 62*b* contact the filters 63, the condensed water may connect the lower electrodes 61*b*, 62*a*, 62*b* to the electrodes that oppose the lower electrodes 61*b*, 62*a*, 62*b* via the filters 63 (in other words, electrodes having an opposite polarity to the lower electrodes). Therefore, to suppress conduction between the anode and the cathode caused by the condensed water, a thickness ds of the space layer 70 may be made greater than a height of the droplets of condensed water existing on the lower electrodes 61*b*, 62*a*, 62*b*. As the thickness ds of the space layer 70 is increased, however, a sectional area of the filter 63 between the anode and the cathode in a vertical direction decreases relative to the sectional area thereof in the flow direction of the blow-by gas, and as a result, the oil particle collection ratio of the oil removal apparatus 6 decreases.

When, on the other hand, hydrophilic treatment is implemented on the surfaces of the lower electrodes 61*b*, 62*a*, 62*b* that contact the space layers 70, as shown in FIG. 5B, the droplets of condensed water dripping onto the lower electrodes 61*b*, 62*a*, 62*b* are less likely to remain in droplet form on the lower electrodes 61*b*, 62*a*, 62*b*, and therefore more likely to spread thinly over the surfaces of the lower electrodes 61*b*, 62*a*, 62*b*. The condensed water on the lower electrodes 61*b*, 62*a*, 62*b* is therefore unlikely to contact the filter 63 even when the thickness ds of the space layer 70 is reduced. Hence, conduction between the anode and the cathode caused by the condensed water can be suppressed even when the thickness ds of the space layer 70 is reduced. By reducing the thickness ds of the space layer 70, therefore, a reduction in the oil particle collection ratio of the oil removal apparatus 6 can be suppressed.

Fourth Modified Example

Further, hydrophobic treatment may be implemented on the surface of the fiber forming the filter 63. Processing for coating the surface of the fiber with a substance containing a saturated fluoroalkyl group, an alkylsilyl group, a fluorosilyl group, or a long chain alkyl group as a functional group may be cited as an example of hydrophobic treatment. In this case, condensed water is more likely to form droplets on the surface of the fiber forming the filter 63 and less likely to infiltrate the fiber. Accordingly, the condensed water is less likely to spread through the filter 63. Furthermore, the condensed water droplets are more likely to drip downward in the gravitational direction, and therefore the condensed water is less likely to remain in the filter 63. Hence, by implementing hydrophobic treatment on the surface of the fiber forming the filter 63, conduction between the anode and the cathode caused by the condensed water can be suppressed.

Second Embodiment

An internal combustion engine and an intake/exhaust system thereof according to a second embodiment are configured identically to the first embodiment. In an oil removal apparatus according to this embodiment, the configuration for suppressing conduction between the anode and the cathode caused by condensed water differs from the first embodiment. FIG. 6 is a schematic view showing a configuration of the oil removal apparatus according to this embodiment. Note that upper and lower sides of FIG. 6 correspond to the upper and lower sides in the gravitational direction when the oil removal apparatus 6 is installed in a vehicle. Further, black-outlined arrows in FIG. 6 denote the flow of the blow-by gas.

In the oil removal apparatus according to this embodiment, a water blocking plate 80 is provided in place of the space layer 70 of the oil removal apparatus according to the first embodiment. The water blocking plate 80 takes the shape of a flat plate extending in the flow direction of the blow-by gas. The water blocking plate 80 is sandwiched within the filters 63 provided respectively between the anode 61*a* of the first bipolar electrode 61 and the cathode 62*b* of the second bipolar electrode 62, between the cathode 62*b* and the anode 62*a* of the second bipolar electrode 62, and between the anode 62*a* of the second bipolar electrode 62 and the cathode 61*b* of the first bipolar electrode 61. In other words, the filter 63 is divided by the water blocking plate 80 into an anode side and a cathode side. Hereafter, the filter positioned on the upper side in the gravitational direction, of the filter 63 divided by the water blocking plate 80, will be referred to as an upper filter 63*c*, and the filter positioned on the lower side in the gravitational direction will be referred to as a lower filter 63*d*.

The water blocking plate 80 is formed from an insulator, and is structured to be less permeable than the filter 63. In other words, the water blocking plate 80 has a higher density than the filter 63 so that water is less likely to infiltrate. Glass epoxy resin may be cited as an example of a material of the water blocking plate 80. Alternatively, a component obtained by implementing superhydrophobic treatment on a surface of a plate-shaped insulating material may be used as the water blocking plate.

With the configuration described above, condensed water is unlikely to infiltrate the water blocking plate 80. Therefore, even when condensed water spreads respectively through the upper filter 63*c* and the lower filter 63*d*, the condensed water spreading through one of the filters does not reach the other filter. In other words, the water blocking plate 80 prevents the condensed water from connecting the anode and the cathode of the bipolar electrode, which oppose each other on either side of the filter 63. As a result, conduction between the anode and the cathode caused by the condensed water can be suppressed.

Moreover, with the configuration described above, dielectric polarization occurs likewise in the water blocking plates 80 when a voltage is applied to the bipolar electrodes 61, 62. The dielectric polarization force generated as a result acts on the oil particles. Hence, when the water blocking plates 80 are provided to suppress conduction between the anode and the cathode caused by condensed water, a reduction in the oil particle collection ratio of the oil removal apparatus 6 is even less likely to occur than when the space layers 70 are provided, as in the configuration according to the first embodiment.

First Modified Example

Note that when the water blocking plates 80 are provided in the oil removal apparatus 6 to suppress conduction between the anode and the cathode caused by condensed water, in contrast to a case in which the space layers 70 are provided, as in the configuration according to the first embodiment, the anodes and the cathodes of the bipolar electrodes do not necessarily have to be arranged in the gravitational direction upon installation of the oil removal apparatus 6 in a vehicle. In other words, a configuration such as that shown in FIG. 7, in which the anodes 61*a*, 62*a* and cathodes 62*a*, 62*b* of the bipolar electrodes 61, 62 are arranged in a horizontal direction when the oil removal apparatus 6 is installed in a vehicle may be employed as the configuration of the oil removal apparatus 6 (upper and lower sides in FIG. 7 correspond to the upper and lower sides in the gravitational direction when the oil removal apparatus 6 is installed in a vehicle). In this case, the respective water blocking plates 80 are also arranged in the horizontal direction.

Second Modified Example

Furthermore, the water blocking plates 80 do not necessarily have to be sandwiched within the filters 63. In other words, a configuration in which the water blocking plate 80 is sandwiched between the filter 63 and the anode and/or between the filter 63 and the cathode may be employed as the configuration of the oil removal apparatus 6. With this configuration, even when condensed water spreads through the filter 63, the condensed water does not spread to the anode or the cathode. In other words, the water blocking plate 80 prevents the condensed water from connecting the anode and the cathode of the bipolar electrode, which oppose each other on either side of the filter 63.

Third Modified Example

Further, a configuration such as that shown in FIG. 8, in which the surfaces of the anode and the cathode of bipolar electrode are covered with a water blocking coating layer 81 in place of the water blocking plates 80, may be employed as the configuration of the oil removal apparatus 6. In this case, the surfaces of the respective electrodes that contact the filter 63 are coated with an insulating material having a similarly low permeability to the material forming the water blocking plate 80. Fluorine resin may be cited as an example of a coating material. In so doing, similar effects to that of a case in which the water blocking plate 80 is sandwiched between the electrode and the filter 63 can be obtained. Note that likewise with this configuration, the coating layer 81 does not necessarily have to be provided on both the anode and the cathode that oppose each other on either side of the filter 63, and may be provided on only one thereof.

What is claimed is:

1. An oil removal apparatus that removes oil particles contained in blow-by gas flowing through a blow-by gas passage of an internal combustion engine, comprising:

a bipolar electrode having an anode and a cathode that extend in a flow direction of said blow-by gas;

a voltage applicator that applies a voltage to said bipolar electrode;

a filter, which is a fibrous filter, and which is disposed between said anode and said cathode of said bipolar electrode, in which dielectric polarization occurs when said voltage applicator applies a voltage to said bipolar electrode, and in which oil particles contained in blow-by gas are collected by said filter due to occurrence of the dielectric polarization; and an insulating layer that is sandwiched either between said filter and at least one of said anode and said cathode of said bipolar electrode, or within said filter so as to extend in said flow direction of said blow-by gas, wherein:

said insulating layer has an insulating property to prevent condensed water generated from moisture in said blow-by gas from connecting said anode and said cathode of said bipolar electrode, said anode and said cathode of said bipolar electrode are arranged in a vertical gravitational direction when in a state of said oil removal apparatus being installed in a vehicle, and said insulating layer is a space layer that is positioned between said filter and at least one of said anode and said cathode of said bipolar electrode, said space layer defining a space through which said blow-by gas flows.

2. An oil removal apparatus that removes oil particles contained in blow-by gas flowing through a blow-by gas passage of an internal combustion engine, comprising:

a bipolar electrode having an anode and a cathode that extend in a flow direction of said blow-by gas;

a voltage applicator that applies a voltage to said bipolar electrode;

a filter, which is a fibrous filter, and which is disposed between said anode and said cathode of said bipolar electrode, in which dielectric polarization occurs when said voltage applicator applies a voltage to said bipolar electrode, and in which oil particles contained in blow-by gas are collected by said filter due to occurrence of the dielectric polarization; and an insulating layer that is sandwiched either between said filter and at least one of said anode and said cathode of said bipolar electrode, or within said filter so as to extend in said flow direction of said blow-by gas, wherein:

said insulating layer has an insulating property to prevent condensed water generated from moisture in said blow-by gas from connecting said anode and said cathode of said bipolar electrode, said anode and said cathode of said bipolar electrode are arranged in a vertical gravitational direction when in a state of said oil removal apparatus being installed in a vehicle, said filter is divided into an anode side filter positioned on an anode side and a cathode side filter positioned on a cathode side, and said insulating layer is a space layer that is positioned between said anode side filter and said cathode side filter, said space layer defining a space through which said blow-by gas flows.

3. The oil removal apparatus according to claim 1, wherein a surface of fiber forming said fibrous filter is hydrophobic.

4. The oil removal apparatus according to claim 1, wherein said space layer is formed between said filter and a lower electrode, which is an electrode, from among said anode and said cathode of said bipolar electrode, that is positioned below said filter in said vertical gravitational direction when in a state of said oil removal apparatus being installed in a vehicle, and a surface of said lower electrode that contacts said space layer is hydrophilic.

5. An oil removal apparatus that removes oil particles contained in blow-by gas flowing through a blow-by gas passage of an internal combustion engine, comprising:

a bipolar electrode having an anode and a cathode that extend in a flow direction of said blow-by gas;

a voltage applicator that applies a voltage to said bipolar electrode;

a filter, which is a fibrous filter, and which is disposed between said anode and said cathode of said bipolar electrode, in which dielectric polarization occurs when said voltage applicator applies a voltage to said bipolar electrode, and in which oil particles contained in blow-by gas are collected by said filter due to occurrence of the dielectric polarization; and an insulating layer that is sandwiched either between said filter and at least one of said anode and said cathode of said bipolar electrode, or within said filter so as to extend in said flow direction of said blow-by gas, wherein:

said insulating layer has an insulating property to prevent condensed water generated from moisture in said blow-by gas from connecting said anode and said cathode of said bipolar electrode, and said insulating layer is a water blocking layer that is formed from an insulator and is less permeable than said filter.

6. The oil removal apparatus according to claim 5, wherein said water blocking layer is formed from a flat plate-shaped water blocking plate that extends in said flow direction of said blow-by gas.

7. The oil removal apparatus according to claim 5, wherein said water blocking layer is a coating layer covering a surface of said anode or said cathode.

8. The oil removal apparatus according to claim 2, wherein a surface of fiber forming said fibrous filter is hydrophobic.

9. The oil removal apparatus according to claim 2, wherein said space layer is formed between said filter and said bipolar electrode, said bipolar electrode is a lower electrode positioned below said filter in said vertical gravitational direction when said oil removal apparatus is installed in a vehicle, and a surface of said bipolar electrode that contacts said space layer is hydrophilic.

* * * * *